US011228117B2

(12) United States Patent
Charaabi

(10) Patent No.: US 11,228,117 B2
(45) Date of Patent: Jan. 18, 2022

(54) SUPPORT MEMBER FOR FORMING AN ARRAY OF DIPOLE ANTENNAS, AND AN ARRAY OF DIPOLE ANTENNAS

(71) Applicant: NOKIA SHANGHAI BELL CO., LTD., Shanghai (CN)

(72) Inventor: Zied Charaabi, Lannion (FR)

(73) Assignee: NOKIA SHANGHAI BELL CO., LTD., Shanghai (CN)

( * ) Notice: Subject to any disclaimer, the term of this patent is extended or adjusted under 35 U.S.C. 154(b) by 0 days.

(21) Appl. No.: 16/778,472

(22) Filed: Jan. 31, 2020

(65) Prior Publication Data

US 2020/0251830 A1 Aug. 6, 2020

(30) Foreign Application Priority Data

Feb. 1, 2019 (EP) ..... 19155172

(51) Int. Cl.

| | |
|---|---|
| ***H01Q 21/26*** | (2006.01) |
| ***H01Q 21/06*** | (2006.01) |
| ***H01Q 1/24*** | (2006.01) |
| *H01Q 5/48* | (2015.01) |
| *H01Q 9/28* | (2006.01) |
| *H01Q 19/10* | (2006.01) |

(52) U.S. Cl.

CPC ..... *H01Q 21/062* (2013.01); *H01Q 1/241* (2013.01); *H01Q 21/26* (2013.01); *H01Q 5/48* (2015.01); *H01Q 9/285* (2013.01); *H01Q 19/108* (2013.01)

(58) Field of Classification Search

CPC ..... H01Q 21/062; H01Q 1/241; H01Q 21/26; H01Q 5/48; H01Q 9/285; H01Q 19/108

USPC ..... 343/798, 793, 795, 797

See application file for complete search history.

(56) References Cited

U.S. PATENT DOCUMENTS

| | | | | |
|---|---|---|---|---|
| 9,397,404 | B1 * | 7/2016 | McDevitt | H01Q 21/08 |
| 2018/0034161 | A1 | 2/2018 | Le et al. | |

FOREIGN PATENT DOCUMENTS

| | | | |
|---|---|---|---|
| CN | 102804495 | A | 11/2012 |
| CN | 107275804 | A | 10/2017 |
| CN | 207834560 | U | 9/2018 |
| KR | 100750850 | B1 | 8/2007 |
| WO | WO 02/23669 | A1 | 3/2002 |

(Continued)

OTHER PUBLICATIONS

First Office Action dated Dec. 3, 2020 corresponding to Chinese Patent Application No. 202010079110.7.

(Continued)

*Primary Examiner* — Joseph J Lauture

(74) *Attorney, Agent, or Firm* — Squire Patton Boggs (US) LLP

(57) ABSTRACT

A support member for arrangement with additional support members to form an array of dipole antennas. The support member includes a first portion of a conductive arm of a dipole antenna, and a first portion of a conductive arm of another dipole antenna. A second portion of the conductive arm of the dipole antenna extends from the first portion of the conductive arm of the dipole antenna towards the first portion of the conductive arm of the other dipole antenna, defining a gap in a direct current path between the second portion of the conductive arm of the dipole antenna and the first portion of the conductive arm of the other dipole antenna.

15 Claims, 3 Drawing Sheets

(56) References Cited

FOREIGN PATENT DOCUMENTS

WO WO 2010/142756 A1 12/2010

OTHER PUBLICATIONS

Extended European Search Report dated Jul. 30, 2019 corresponding to European Patent Application No. 19155172.0.
Yongming Yang et al., "A Compact Omni-directional Circularly Polarized Antenna," Proceedings of 2014 3rd Asia-Pacific Conference on Antennas and Propagation, IEEE, Jul. 26, 2014, pp. 329-332, XP032710287.

* cited by examiner

SUPPORT MEMBER FOR FORMING AN ARRAY OF DIPOLE ANTENNAS, AND AN ARRAY OF DIPOLE ANTENNAS

TECHNOLOGICAL FIELD

Embodiments of the present disclosure relate to support members for forming an array of dipole antennas and an array of dipole antennas.

BACKGROUND

Wireless telecommunication can occur in different frequency bands. It is common practice to use different antenna arrangements for the different bands. However, if these antenna arrangements are physically separate then the volume or area required is increased. It is therefore desirable, in some circumstances, to use the same area or volume for multiple antenna arrangements.

BRIEF SUMMARY

According to various, but not necessarily all, embodiments there is provided a support member for arrangement with additional support members to form an array of dipole antennas, the support member comprising:

a first portion of a conductive arm of a dipole antenna;

a first portion of a conductive arm of another dipole antenna; and a second portion of the conductive arm of the dipole antenna extending from the first portion of the conductive arm of the dipole antenna towards the first portion of the conductive arm of the other dipole antenna, defining a gap in a direct current path between the second portion of the conductive arm of the dipole antenna and the first portion of the conductive arm of the other dipole antenna.

According to various, but not necessarily all, embodiments there is provided examples as claimed in the appended claims.

According to various, but not necessarily all, embodiments there is provided an array of dipole antennas comprising:

(i) a first support member 2 forming a first side of a cuboid and comprising:

a first portion of a first conductive arm of a first dipole antenna a first portion of a second conductive arm of a second dipole antenna a first conductive element extending from the first portion of the first conductive arm of the first dipole antenna towards the first portion of the second conductive arm of the second dipole antenna, defining a gap 6 in a direct current path between the first conductive element and the first portion of the second conductive arm of the second dipole antenna;

(ii) a second support member 2 forming a second side of the cuboid and comprising:

a first portion of a first conductive arm of the second dipole antenna a first portion of a second conductive arm of a third dipole antenna a second conductive element extending from the a first portion of a first conductive arm of the second dipole antenna towards the first portion of the second conductive arm of the third dipole antenna, defining a gap 6 in a direct current path between the second conductive element and the first portion of a second conductive arm of the third dipole antenna;

(iii) a third support member 2 forming a third side of the cuboid and comprising:

a first portion of a first conductive arm of the third dipole antenna a first portion of a second conductive arm of a fourth dipole antenna a third conductive element extending from the first portion of a first conductive arm of the third dipole antenna towards the first portion of the second conductive arm of the fourth dipole antenna, defining a gap 6 in a direct current path between the third conductive element and the first portion of the second conductive arm of the fourth dipole antenna;

(iv) a fourth support member 2 forming a fourth side of the cuboid and comprising:

a first portion of a first conductive arm of the fourth dipole antenna a first portion of a second conductive arm of the first dipole antenna a fourth conductive element extending from the first portion of a first conductive arm of the fourth dipole antenna towards the first portion of the second conductive arm of the first dipole antenna, defining a gap 6 in a direct current path between the fourth conductive element and the first portion of the second conductive arm of the first dipole antenna;

wherein the first (N) conductive element provides directly a first arm of the first dipole antenna (N) and the fourth conductive element (N−1) provides indirectly a second arm of the first dipole antenna (N);

the second conductive element provides directly a first arm of the second dipole antenna and the first conductive element provides indirectly a second arm of the second dipole antenna;

the third conductive element provides directly a first arm of the third dipole antenna and the second conductive element provides indirectly a second arm of the third dipole antenna;

the fourth conductive element provides directly a first arm of the fourth dipole antenna and the third conductive element provides indirectly a second arm of the fourth dipole antenna.

BRIEF DESCRIPTION

Some example embodiments will now be described with reference to the accompanying drawings in which.

DETAILED DESCRIPTION

Figure 1:
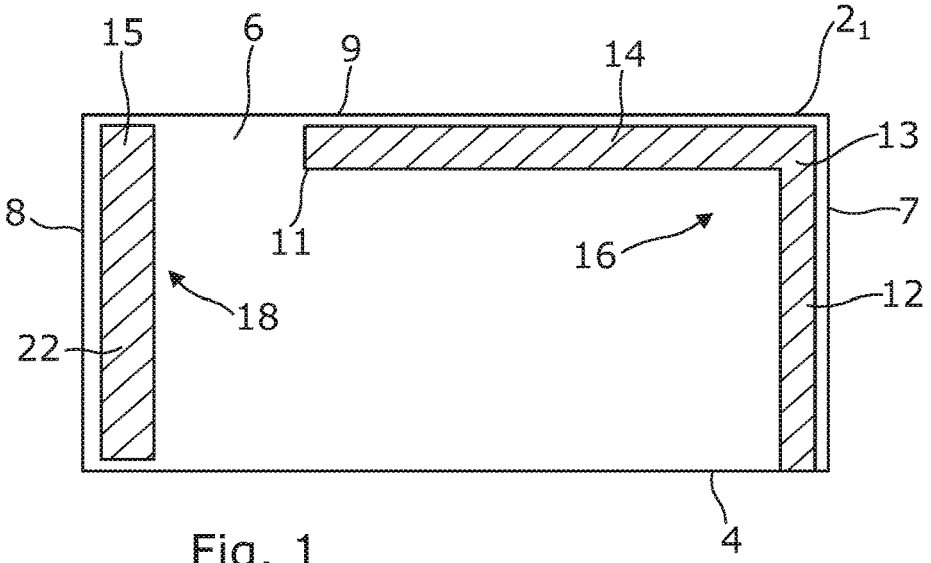
FIG. 1 shows an example embodiment of the subject matter described herein.

FIG. 1 illustrates an example of a support member 2 for arrangement with additional support members 2 to form an array 100 of dipole antennas $\mathbf{10}_i$.

Figure 2:
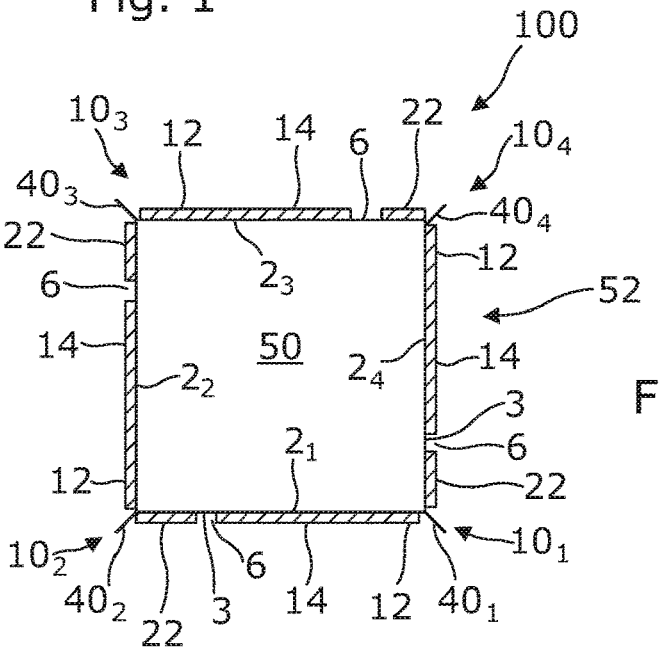
FIG. 2 shows another example embodiment of the subject matter described herein.

FIG. 2 illustrates an example in which multiple support members $\mathbf{2}_i$ are arranged to form an array 100 of dipole antennas.

Referring back to FIG. 1, in this example the support member $\mathbf{2}_i$ is a printed circuit board. The printed circuit board $\mathbf{2}_1$ comprises an insulating or dielectric substrate 4 that supports conductors. These conductors may, for example, be printed onto the substrate 4. The conductors include a first portion 12 of a conductive arm 16 of a dipole antenna $\mathbf{10}_1$, a first portion 22 of a conductive arm 18 of another dipole antenna $\mathbf{10}_2$, and a second portion 14 of the conductive arm 16 of the dipole antenna $\mathbf{10}_1$.

The second portion 14 of the conductive arm 16 of the dipole antenna $\mathbf{10}_1$ extends from the first portion 12 of the conductive arm 16 of the dipole antenna $\mathbf{10}_1$ towards the first portion 22 of the conductive arm 18 of the other dipole antenna $\mathbf{10}_2$. However, the second portion 14 of the conductive arm 16 of the dipole antenna $\mathbf{10}_1$ does not extend to electrically connect with the first portion 12 of the conductive arm 18 of the other dipole antenna $\mathbf{10}_2$ and defines a gap 6 in a direct current path between the second portion 14 of the conductive arm 16 of the dipole antenna $\mathbf{10}_1$ and the first portion 22 of the conductive arm 18 of the other dipole antenna $\mathbf{10}_2$. While the gap 6 is a gap in the direct current path, it is also a physical gap between conductors. A gap in the direct current path means that the electric circuit is broken such that a direct current (DC) cannot flow. A physical gap between the conductors is a bridge between the conductors that is insulating rather than electrically conducting.

The second portion 14 of the conductive arm 16 of the dipole antenna $\mathbf{10}_1$ is configured to provide indirectly, via capacitive coupling across the gap 6, a second portion of the conductive arm 18 of the other dipole antenna $\mathbf{10}_2$.

In this example, the first portion 12 of the conductive arm 16 of the dipole antenna $\mathbf{10}_1$ is a straight conductor, extending in a first direction (vertical as illustrated), the first portion 22 of the conductive arm 18 of the other dipole antenna $\mathbf{10}_2$ is a straight conductor extending in the first direction (vertical as illustrated), and the second portion 14 of the conductive arm 16 of the dipole antenna $\mathbf{10}_1$ is a straight conductor extending in a second direction orthogonal to the first direction (horizontal as illustrated).

In the illustrated example, the first portion 12 of the conductive arm 16 of the dipole antenna $\mathbf{10}_1$ extends parallel to and directly adjacent to a first lateral edge 7 of the printed circuit board 2. The first portion 22 of the conductive arm 18 of the other dipole antenna $\mathbf{10}_2$ extends parallel to and is directly adjacent a second lateral edge 8 of the printed circuit board 2. The second lateral edge 8 is parallel to the first lateral edge 7 and directly opposes the first lateral edge. In the illustrated example, the first lateral edge 7 is a rightmost edge and the second lateral edge 8 is the leftmost lateral edge of the printed circuit board 2. However, the arrangement of conductors 22, 14, 12 could be reversed and the first lateral edge 7 could be the rightmost edge. The second portion 14 of the conductive arm 16 of the dipole antenna $\mathbf{10}_1$ extends parallel to and directly adjacent to an uppermost edge 9 of the printed circuit board 2.

The first portion 12 of the conductive arm 16 of the dipole antenna $\mathbf{10}_1$ provides a direct feed to the second portion 14 of the conductive arm 16 of the dipole antenna $\mathbf{10}_1$. The first portion 22 of the conductive arm 18 of the other dipole antenna $\mathbf{10}_2$ provides an indirect feed because of the gap 6 to the second portion 14 of the conductive arm of the dipole antenna $\mathbf{10}_1$. The second portion 14 of the conductive arm 16 of the dipole antenna $\mathbf{10}_i$ therefore indirectly provides a second portion of the conductive arm 18 of the other dipole antenna $\mathbf{10}_2$. The conductive arm 18 of the other dipole antenna $\mathbf{10}_2$ is a split dipole arm, split by the gap 6, whereas the conductive arm 16 of the dipole antenna $\mathbf{10}_1$ is not a split dipole arm. A direct feed provides a direct current path, whereas an indirect feed does not.

The second portion 14 of the conductive arm 16 of the dipole antenna $\mathbf{10}_1$ terminates at a free end 11 adjacent the gap 6. The second portion 14 of the conductive arm 16 extends from an uppermost part 13 of the first portion 12 of the conductive arm 16 of the dipole antenna $\mathbf{10}_1$ and extends towards an uppermost part 15 of the first portion 22 of the conductive arm 18 of the other dipole antenna $\mathbf{10}_2$.

In the example illustrated, the combination of the first portion 12 of the conductive arm 16 of the dipole antenna $\mathbf{10}_1$ and the second portion 14 of the conductive arm 16 of the dipole antenna $\mathbf{10}_1$ forms a conductive arm 16 of the dipole antenna $\mathbf{10}_1$ that is substantially L-shaped (L rotated through 180°). The first portion 22 of the conductive arm 18 of the other dipole antenna $\mathbf{10}_2$ is not L-shaped. In other examples, the first portion 22 of the conductive arm 18 of the other dipole antenna $\mathbf{10}_2$ may be differently shaped and may have a stub or extension directed towards the terminal part 11 of the second portion 14 of the conductive arm 16 of the dipole antenna $\mathbf{10}_1$.

FIG. 2 illustrates an example of an array 100 of dipole antennas 10 formed from four arranged printed circuit boards $\mathbf{2}_i$. The arranged printed circuit boards $\mathbf{2}_i$ are each a printed circuit board 2 as previously described in relation to FIG. 1. Each of the four printed circuit boards $\mathbf{2}_i$ is arranged so that it has a fixed position relative to two adjacent neighboring printed circuit boards $\mathbf{2}_i$. This fixed arrangement may be achieved by physically interconnecting the printed circuit boards $\mathbf{2}_i$ or by any other suitable means. In some example, the printed circuit boards $\mathbf{2}_i$ are not physically interconnected. In some example, the adjacent printed circuit boards $\mathbf{2}_i$ may be separated by narrow gaps.

The four printed circuit boards $\mathbf{2}_i$ may be flat or curved and are arranged to form a hollow shape 52 where each of the printed circuit boards 2 provides one face of the shape surrounding an open central void 50.

In this example, the four printed circuit boards $\mathbf{2}_i$ are flat and are arranged to form a hollow parallelepiped 52 where each of the printed circuit boards 2 provides one face of the parallelepiped. In other examples, the four printed circuit boards $\mathbf{2}_i$ may each be curved. The parallelepiped 52 has two open opposing faces and an open central void 50 surrounded by the four printed circuit boards $\mathbf{2}_i$. In some, but not necessarily all examples, the parallelepiped 52 may take the shape of a cuboid or cube.

In the example illustrated, for each of the printed circuit boards $\mathbf{2}_i$, the first portions 12, 22 of the conductive arms 16, 18 and the second portion 14 of the conductive arm 16 of the dipole antenna are on the same outer face 3 of the printed circuit board 2.

In FIG. 2 there is a first printed circuit board $\mathbf{2}_1$, a second printed circuit board $\mathbf{2}_2$, a third printed circuit board $\mathbf{2}_3$ and a fourth printed circuit board $\mathbf{2}_4$.

The first printed circuit board $\mathbf{2}_1$ is arranged adjacent to, for example physically connected to, the second printed circuit board $\mathbf{2}_2$ at an edge of the parallelepiped. At the edge, the first portion 22 of the conductive arm 18 of the first printed circuit board $\mathbf{2}_1$ is adjacent the first portion 12 of the conductive arm 16 of the second printed circuit board $\mathbf{2}_2$. The second portion 14 of the conductive arm 16 of the second printed circuit board $\mathbf{2}_2$ provides directly (without a gap) a first arm of a second dipole antenna $\mathbf{10}_2$ and the second portion 14 of the conductive arm 16 of the first printed circuit board $\mathbf{2}_1$ provides indirectly, via the gap 6, a second arm of the second dipole antenna $\mathbf{10}_2$.

The second printed circuit board $\mathbf{2}_2$ is arranged adjacent to, for example physically connected to, the third printed circuit board $\mathbf{2}_3$ at an edge of the parallelepiped. At the edge, the first portion 22 of the conductive arm 18 of the second printed circuit board $\mathbf{2}_2$ is adjacent the first portion 12 of the conductive arm 16 of the third printed circuit board $\mathbf{2}_3$. The second portion 14 of the conductive arm 16 of the third printed circuit board $\mathbf{2}_3$ provides directly (without a gap) a first arm of a third dipole antenna $\mathbf{10}_3$ and the second portion 14 of the conductive arm 16 of the second printed circuit board $\mathbf{2}_2$ provides indirectly, via the gap 6, a second arm of the third dipole antenna $\mathbf{10}_3$.

The third printed circuit board $\mathbf{2}_3$ is arranged adjacent to, for example physically connected to, the fourth printed circuit board $\mathbf{2}_4$ at an edge of the parallelepiped. At the edge, the first portion 22 of the conductive arm 18 of the third printed circuit board $\mathbf{2}_3$ is adjacent the first portion 12 of the conductive arm 16 of the fourth printed circuit board $\mathbf{2}_4$. The second portion 14 of the conductive arm 16 of the fourth printed circuit board $\mathbf{2}_4$ provides directly (without a gap) a first arm of a fourth dipole antenna $\mathbf{10}_4$ and the second portion 14 of the conductive arm 16 of the third printed circuit board $\mathbf{2}_3$ provides indirectly, via the gap 6, a second arm of the fourth dipole antenna $\mathbf{10}_4$.

The fourth printed circuit board $\mathbf{2}_4$ is arranged adjacent to, for example physically connected to, the first printed circuit board $\mathbf{2}_1$ at an edge of the parallelepiped. At the edge, the first portion 22 of the conductive arm 18 of the fourth printed circuit board $\mathbf{2}_4$ is adjacent the first portion 12 of the conductive arm 16 of the first printed circuit board $\mathbf{2}_1$. The second portion 14 of the conductive arm 16 of the first printed circuit board $\mathbf{2}_1$ provides directly (without a gap) a first arm of a first dipole antenna $\mathbf{10}_1$ and the second portion 14 of the conductive arm 16 of the fourth printed circuit board $\mathbf{2}_4$ provides indirectly, via the gap 6, a second arm of the first dipole antenna $\mathbf{10}_1$.

If a gap is present there is no direct current path (the electric circuit is broken such that a direct current (DC) cannot flow). If a gap is not present there is a direct current path (the electric circuit is complete such that a direct current (DC) can flow). A gap between the conductors is a bridge between the conductors that is insulating rather than electrically conducting.

There is therefore a dipole antenna 10 at each corner edge of the parallelepiped 52. Each of the dipoles 10 comprises an L-shaped first dipole arm on one face at the corner edge and a split (L-shaped) second dipole arm on the adjacent face. The two L-shaped dipole arms one of which is split by gap 6 and the other one which is not, are back-to-back at the corner edge of the parallelepiped 52.

A first feed $\mathbf{40}_1$ is coupled to the first dipole antenna $\mathbf{10}_1$. The first feed $\mathbf{40}_1$ is coupled to the first portions 12, 22 of respective conductive arms 16, 18 that extend along respective first and fourth printed circuit boards $\mathbf{2}_1$, $\mathbf{2}_4$ at a first edge of the parallelepiped 30.

A second feed $\mathbf{40}_2$ is coupled to the second dipole antenna $\mathbf{10}_2$. The second feed $\mathbf{40}_2$ is coupled to the first portions 12, 22 of respective conductive arms 16, 18 that extend along respective second and first printed circuit boards $\mathbf{2}_2$, $\mathbf{2}_1$ at a second edge of the parallelepiped 30.

A third feed $\mathbf{40}_3$ is coupled to the third dipole antenna $\mathbf{10}_3$. The third feed $\mathbf{40}_3$ is coupled to the first portions 12, 22 of respective conductive arms 16, 18 that extend along respective third and second printed circuit boards $\mathbf{2}_3$, $\mathbf{2}_2$ at a third edge of the parallelepiped 30.

A fourth feed $\mathbf{40}_4$ is coupled to the fourth dipole antenna $\mathbf{10}_4$. The fourth feed $\mathbf{40}_4$ is coupled to the first portions 12, 22 of respective conductive arms 16, 18 that extend along respective fourth and third printed circuit boards $\mathbf{2}_4$, $\mathbf{2}_3$ at a fourth edge of the parallelepiped 30.

Figure 3A:
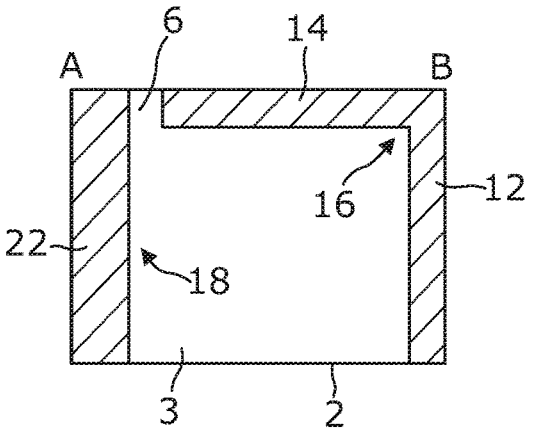
FIGS. 3A and 3B show another example embodiment of the subject matter described herein.
Figure 3B:
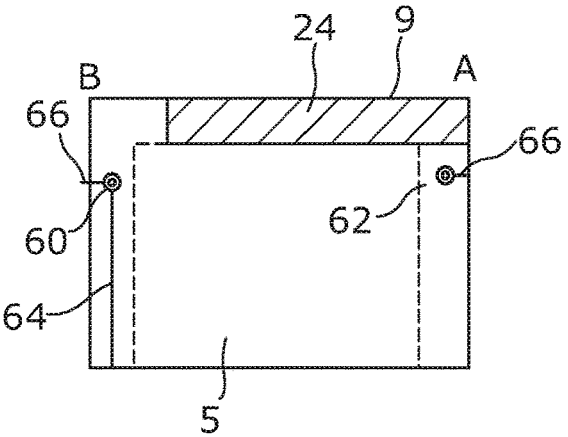

FIGS. 3A and 3B illustrate an example of a printed circuit board 2 as previously described. FIG. 3A illustrates a first face 3 of the printed circuit board 2 and FIG. 3B illustrates a second face 5 of the printed circuit board 2, that opposes the first face 3. In the example illustrated in FIG. 2, the first face 3 is an outer face of the parallelepiped 52 and the second face 5 is an inner face of the parallelepiped 52.

The first face 3 of the printed circuit board 2 comprises a first portion 12 of a conductive arm 16 of a dipole antenna $\mathbf{10}_n$, a first portion 22 of a conductive arm 18 of another dipole antenna $\mathbf{10}_m$, and a second portion 14 of the conductive arm 16 of the dipole antenna $\mathbf{10}_n$ extending from the first portion 12 of the conductive arm 16 of the dipole antenna $\mathbf{10}_n$ towards the first portion 22 of the conductive arm 18 of the other dipole antenna $\mathbf{10}_m$, defining a gap 6 in a direct current path between the second portion 14 of the conductive arm 16 of the dipole antenna $\mathbf{10}_n$ and the first portion 22 of the conductive arm 18 of the other dipole antenna $\mathbf{10}_m$.

The second face 5 comprises an additional conductive element 24. The additional conductive element 24 is physically separated from the second portion 14 of the conductive arm 16 on the first face 3 and physically separated from the first portion 22 of the conductive arm 18 on the first face 3. There is no direct current path between the additional conductive element 24 and the second portion 14 of the conductive arm 16 on the first face 3. There is no direct current path between the additional conductive element 24 and the first portion 22 of the conductive arm 18 on the first face 3.

The additional conductive element 24 is configured to capacitively couple with the second portion 14 of the conductive arm 16 on the first face 3 and the first portion 22 of the conductive arm 18 on the first face 3. This coupling extends an electrical length of the second portion 14 of the conductive arm 16 on the first face 3.

The additional conductive element 24 on the second face 5 is separated from the second portion 14 of the conductive arm 16 on the first face 3 and overlaps the second portion 14 of the conductive arm 16 on the first face 3. The additional conductive element 24 on the second face 5 is separated from the first portion 22 of the conductive arm 18 on the first face 3 and overlaps the first portion 22 of the conductive arm 18 on the first face 3.

In this example, the additional conductive element 24 and the second portion 14 of the conductive arm 16 are separated by the whole depth of the substrate 4 as they are on opposite faces 3, 5, but in other examples they may be separated by less than the depth of a multilayer substrate 4 if, for example, the additional conductive element 24 and the second portion 14 of the conductive arm 16 are in different layers of the multilayer substrate 4.

The additional conductive element 24 is a straight conductor extending in a second direction orthogonal to the first direction (horizontal as illustrated). The additional conductive element 24 extends parallel to and directly adjacent to an uppermost edge 9 of the printed circuit board 2.

A first feed element 60 is associated with the first portion 12 of the conductive arm 16 and a second feed element 62 is associated with the first portion 22 of the conductive arm 18.

In this example, the first feed element 60, associated with the first portion 12 of the conductive arm 16, is on the second face 5 of the printed circuit board 2 and the first portion 12 of the conductive arm 16 is on the first face 3 opposing the second face 5. The first feed element 60 is aligned with an upper portion of the first portion 12 of the conductive arm 16, near the uppermost edge 9.

In this example, the second feed element 62, associated with the first portion 22 of the conductive arm 18, is on the second face 5 of the printed circuit board 2 and the first portion 22 of the conductive arm 18 is on the first face 3 opposing the second face 5. The second feed element 62 is aligned with an upper portion of the first portion 22 of the conductive arm 18, near the uppermost edge 9.

In this example, the first feed element 60 is fed via a feed line 64. In use an electrical interconnect 66 is used to couple the first feed element 60 to a second feed element 62 of the adjacent printed circuit board 2.

In this example, the second feed element 62 is fed, in use, via an electrical interconnect 66 that couples the second feed element 620 to a first feed element 60 of another adjacent printed circuit board 2.

Figure 4:
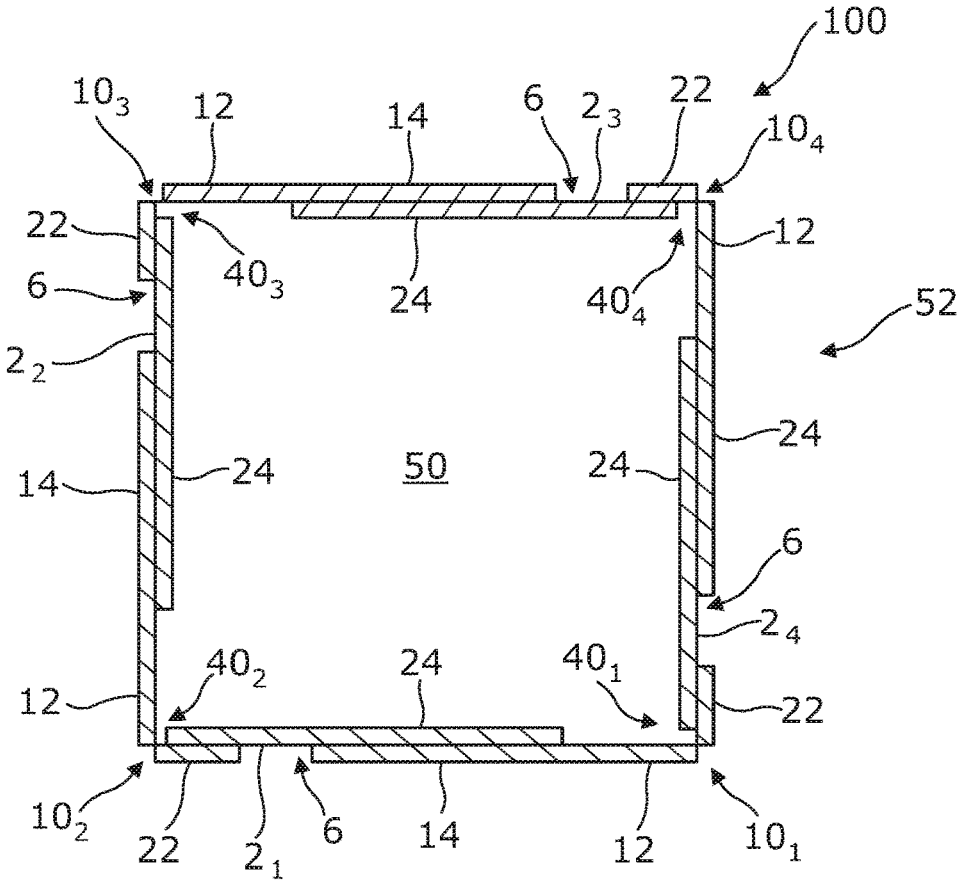
FIGS. 4 and 5 show another example embodiment of the subject matter described herein.

FIG. 4 is similar to FIG. 2. Whereas FIG. 2 illustrates an example of an array 100 of dipole antennas 10 formed from physically interconnecting four printed circuit boards 2 as illustrated in FIG. 1, FIG. 4 illustrates an example of an array 100 of dipole antennas 10 formed from physically interconnecting four printed circuit boards 2 as illustrated in FIG. 3. The description of FIG. 2 is also applicable to FIG. 4.

Figure 5:
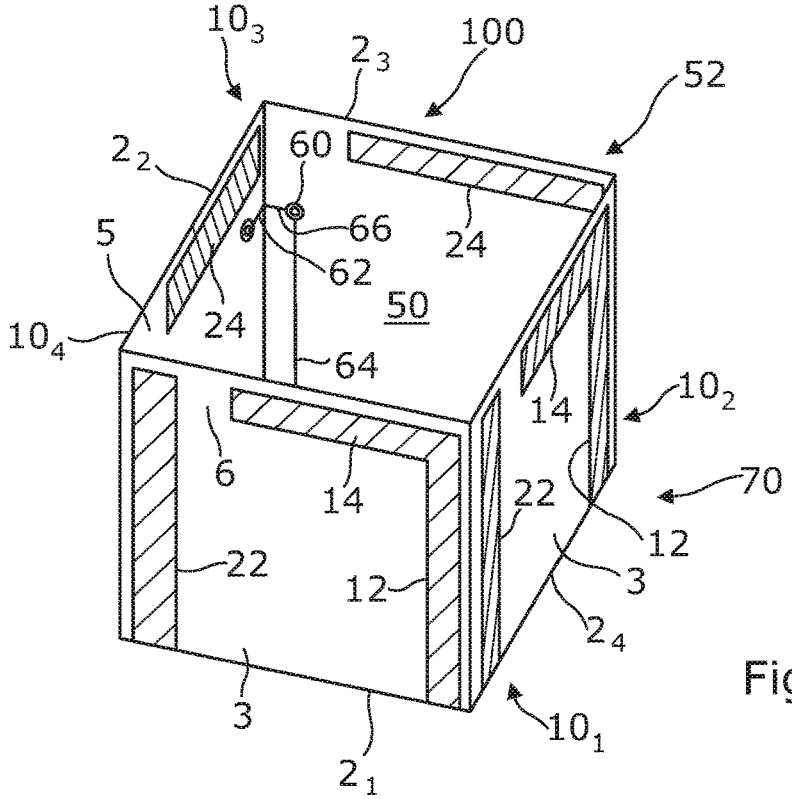

FIG. 5 illustrates the parallelepiped 52 formed from physically interconnecting four printed circuit boards 2 as illustrated in FIG. 3. Whereas FIG. 4 is a plan view, FIG. 5 is a perspective view.

FIG. 5 illustrates that the third printed circuit board $\mathbf{2}_3$ has, on a rear face 5, a first feed element 60 fed via a feed line 64 and that is coupled via an electrical interconnect 66 to a second feed element 60 of the adjacent second printed circuit board $\mathbf{2}_2$.

There are equivalent electrical interconnects at each of the interior corner edges of the parallelepiped 52.

Thus a first feed $\mathbf{40}_1$ is coupled to the first portion 12 of the conductive arm 16 of the first dipole antenna $\mathbf{10}_1$ and the first portion 22 of the other conductive arm 18 of the first dipole antenna $\mathbf{10}_1$ via feedline 64, feed elements 60, 62 and electrical interconnect 66. A second feed $\mathbf{40}_2$ is coupled to the first portion 12 of the conductive arm 16 of the second dipole antenna $\mathbf{10}_2$ and the first portion 22 of the other conductive arm 18 of the second dipole antenna $\mathbf{10}_2$ via feedline 64, feed elements 60, 62 and electrical interconnect 66. A third feed $\mathbf{40}_3$ is coupled to the first portion 12 of the conductive arm 16 of the third dipole antenna $\mathbf{10}_3$ and the first portion 22 of the other conductive arm 18 of the third dipole antenna $\mathbf{10}_3$ via feedline 64, feed elements 60, 62 and electrical interconnect 66. A fourth feed $\mathbf{40}_4$ is coupled to the first portion 12 of the conductive arm 16 of the fourth dipole antenna $\mathbf{10}_4$ and the first portion 22 of the other conductive arm 18 of the fourth dipole antenna $\mathbf{10}_4$ via feedline 64, feed elements 60, 62 and electrical interconnect 66.

In this example, but not necessarily all example, in operation an electrical interconnection is made between the first feed $\mathbf{40}_1$ and the third feed $\mathbf{40}_3$ and an electrical interconnection is made between the second feed $\mathbf{40}_2$ and the fourth feed $\mathbf{40}_4$. This creates a dual-polarized antenna array 100.

The connection between feeds may change for different types of antenna configurations and in some examples the two diagonally opposing dipoles are not connected to each other.

The array 100 of dipole antennas 10, in the shape of the parallelepiped 52, can be inserted within a larger regular array 200 of antennas 202 so that a first subarray 210 of the larger array 200 of antennas 202 is within the void 50 defined by the hollow parallelepiped 52 and a second subarray 212 of the larger array 200 of antennas 202 is outside the hollow parallelepiped 52.

In some but not necessarily all examples, in operation the parallelepiped 52 is placed on a ground plane 70 and the lowermost parts of the first portions 22 and the first portions 12 are electrically interconnected to the ground plane 70.

In other examples, the lowermost parts of the first portions 22 and the first portions 12 are not electrically interconnected to the ground plane 70. A capacitive coupling between the lowermost parts of the first portions 22 and the first portions 12 and the ground plane 70 could provide a similar effect.

In other examples, a ground connection is not required. The grounding connection (if one is needed) could be provided by the feedline on the inside faces with the ground connection being made directly on the surface of the ground plane 70. In this case the ground and RF feed would come together at a junction of two conductive tracks on the ground plane 70 and then project along a single conductive line up the inside face of the printed circuit boards. In other cases, one dipole arm could be connected to the ground plane 70 and the other connected to the RF feed (single-ended feed as opposed to a balanced feed).

Figure 6:
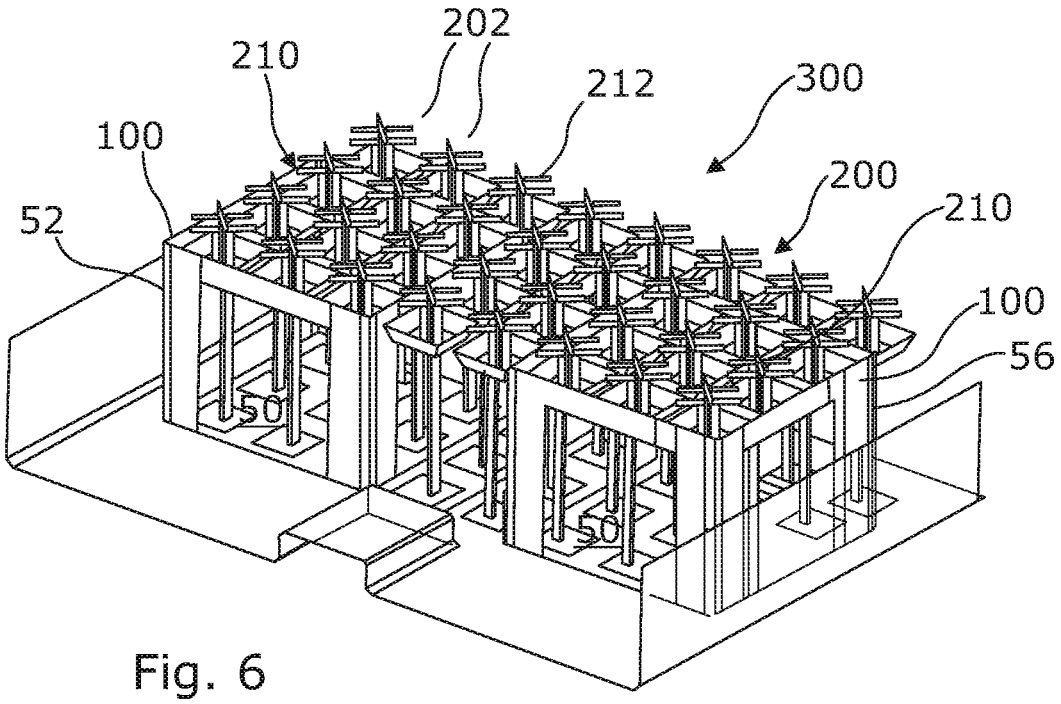
FIG. 6 shows another example embodiment of the subject matter described herein.
Figure 7:
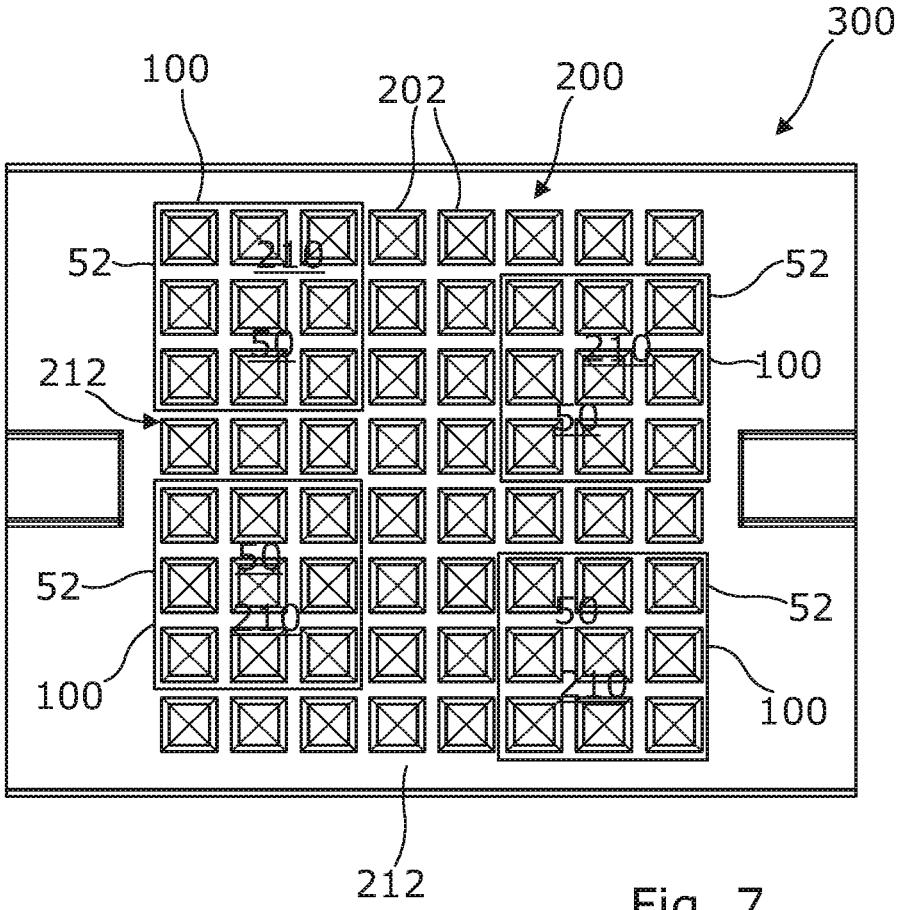
FIG. 7 shows another example embodiment of the subject matter described herein.

FIGS. 6 and 7 illustrate examples of a multi-band system 300 that comprises one or more arrays 100 of dipole antennas 10, as previously described, inserted within a larger regular array 200 of antennas 202 so that a first subarray 210 of the larger array 200 of antennas 202 is within the void 50 defined by the hollow parallelepiped 52 and a second subarray 212 of the larger array 200 of antennas 202 is outside the hollow parallelepiped 52.

The one or more arrays 100 of dipole antennas 10 and the larger regular array 200 of antennas 202 are interleaved and share the same common area.

The array 100 of dipole antennas 10 operates at lower frequencies than the larger regular array 200 of antennas 202 which operates at a higher frequency.

The arrays 100 of dipole antennas 10 operate at a lower frequency band (LB), for example, a band between 600 and 1000 MHz. The antennas 202 operate at a higher frequency band for example between 3 and 4 GHz, above 2 GHz but below 6 GHz or in frequency bands allocated for 5G.

The larger regular array 200 of antennas 202 provides, in some example, an active array that may be used for mMIMO. The arrays 100 of dipole antennas 10 are in some examples passive. The system 300 is then an active-passive system.

The dipole arm 18 of the dipole antennas 10 is a split dipole arm, split by the gap 6, whereas the dipole arm 16 of the dipole antennas 10 is not a split dipole arm. The split dipole arm provides better isolation between the lower frequencies of the antennas 10 and the higher frequencies of the antennas 202.

The dipole antennas 10 of the array 100 of dipole antennas 10 are arranged at 45 degrees to dipoles of the larger regular array 200 of antennas 202. This will also improve isolation between the lower frequencies of the antennas 10 and the higher frequencies of the antennas 202.

It will be appreciated from the foregoing that in at least some examples there is provided an array 100 of dipole antennas 10 comprising:

(i) a first printed circuit board $\mathbf{2}_1$ forming a first side of a cuboid and comprising:

a first portion 12 of a first conductive arm 16 of a first dipole antenna $\mathbf{10}_1$;

a first portion 22 of a second conductive arm 18 of a second dipole antenna $\mathbf{10}_2$, and a first conductive element 14 extending from the first portion 12 of the first conductive arm 16 of the first dipole antenna $\mathbf{10}_1$ towards the first portion 22 of the second conductive arm 18 of the second dipole antenna $\mathbf{10}_2$, defining a gap 6 in a direct current path between the first conductive element 14 and the first portion 10 of the second conductive arm 18 of the second dipole antenna $\mathbf{10}_2$;

(ii) a second printed circuit board $\mathbf{2}_2$ forming a second side of the cuboid and comprising:

a first portion 12 of a first conductive arm 16 of the second dipole antenna $\mathbf{10}_2$;

a first portion 22 of a second conductive arm 18 of a third dipole antenna $\mathbf{10}_3$;

and a second conductive element 14 extending from the first portion 12 of the first conductive arm 16 of the second dipole antenna $\mathbf{10}_2$ towards the first portion 22 of the second conductive arm 18 of the third dipole antenna $\mathbf{10}_3$, defining a gap 6 in a direct current path between the second conductive element 14 and the first portion 22 of the second conductive arm 18 of the third dipole antenna $\mathbf{10}_3$;

(iii) a third printed circuit board $\mathbf{2}_3$ forming a third side of the cuboid and comprising:

a first portion 12 of a first conductive arm 16 of the third dipole antenna $\mathbf{10}_3$; a first portion 22 of a second conductive arm 18 of a fourth dipole antenna $\mathbf{10}_4$; and a third conductive element 14 extending from the first portion 12 of the first conductive arm 16 of the third dipole antenna $\mathbf{10}_3$ towards the first portion 22 of the second conductive arm 18 of the fourth dipole antenna $\mathbf{10}_4$, defining a gap 6 in a direct current path between the third conductive element 14 and the first portion 22 of the second conductive arm 18 of the fourth dipole antenna $\mathbf{10}_4$;

(iv) a fourth printed circuit board $\mathbf{2}_4$ forming a fourth side of the cuboid and comprising:

a first portion 12 of a first conductive arm 16 of the fourth dipole antenna $\mathbf{10}_4$;

a first portion 22 of a second conductive arm 18 of the first dipole antenna $\mathbf{10}_1$; and a fourth conductive element 14 extending from the first portion 12 of a first conductive arm 16 of the fourth dipole antenna $\mathbf{10}_4$ towards the first portion 22 of the second conductive arm 18 of the first dipole antenna $\mathbf{10}_1$, defining a gap 6 in a direct current path between the fourth conductive element 14 and the first portion 22 of the second conductive arm 18 of the first dipole antenna $\mathbf{10}_1$.

The first conductive element 14 of the first printed circuit board $\mathbf{2}_1$ provides directly a first arm of the first dipole antenna $\mathbf{10}_1$ and the fourth conductive element 14 of the fourth printed circuit board $\mathbf{2}_4$ provides indirectly a second arm of the first dipole antenna $\mathbf{10}_1$.

The second conductive element 14 of the second printed circuit board $\mathbf{2}_2$ provides directly a first arm of the second dipole antenna $\mathbf{10}_2$ and the first conductive element 14 of the first printed circuit board $\mathbf{2}_1$ provides indirectly a second arm of the second dipole antenna $\mathbf{10}_2$.

The third conductive element 14 of the third printed circuit board $\mathbf{2}_3$ provides directly a first arm of the third dipole antenna $\mathbf{10}_3$ and the second conductive element 14 of the second printed circuit board $\mathbf{2}_2$ provides indirectly a second arm of the third dipole antenna $\mathbf{10}_3$.

The fourth conductive element 14 of the fourth printed circuit board $\mathbf{2}_4$ provides directly a first arm of the fourth dipole antenna $\mathbf{10}_4$ and the third conductive element 14 of the third printed circuit board $\mathbf{2}_3$ provides indirectly a second arm of the fourth dipole antenna $\mathbf{10}_3$.

In general, the first conductive element 14 of one printed circuit board $\mathbf{2}_n$ provides directly a first arm of a particular dipole antenna $\mathbf{10}_n$ and another conductive element 14 of a different printed circuit board $\mathbf{2}_m$ provides indirectly a second arm of that particular dipole antenna $\mathbf{10}_n$. In the examples illustrated, n=m−1. However, if the arrangement of conductive elements 12, 14, 22 is reversed (pattern reflected in a vertical midline of the printed circuit board) then n=m+1.

A first feed $\mathbf{40}_1$ is coupled to the first portions 12, 22 of the first dipole antenna $\mathbf{10}_1$. A second feed $\mathbf{40}_2$ is coupled to the first portions 12, 22 of the second dipole antenna $\mathbf{10}_2$. A third feed $\mathbf{40}_3$ is coupled to the first portions 12, 22 of the third dipole antenna $\mathbf{10}_3$. A fourth feed $\mathbf{40}_4$ is coupled to the first portions 12, 22 of the fourth dipole antenna $\mathbf{10}_4$.

In some examples there is an electrical interconnection between the first feed $\mathbf{40}_1$ and the third feed $\mathbf{40}_3$, and there is a separate electrical interconnection between the second feed $\mathbf{40}_2$ and the fourth feed $\mathbf{40}_4$.

In at least some of the examples above there is provided a support member $\mathbf{2}_i$ for arrangement with additional support members $\mathbf{2}_j$ to form an array 100 of dipole antennas 10, the support member $\mathbf{2}_i$ comprising:

a first portion 12 of a conductive arm 16 of a dipole antenna $\mathbf{10}_m$;

a first portion 22 of a conductive arm 18 of another dipole antenna $\mathbf{10}_n$; and a second portion 14 of the conductive arm 16 of the dipole antenna $\mathbf{10}_m$ extending from the first portion 12 of the conductive arm 16 of the dipole antenna $\mathbf{10}_m$ towards the first portion 22 of the conductive arm 18 of the other dipole antenna $\mathbf{10}_n$, defining a gap 6 in a direct current path between the second portion 14 of the conductive arm 18 of the dipole antenna $\mathbf{10}_m$ and the first portion 22 of the conductive arm 18 of the other dipole antenna $\mathbf{10}_n$.

In some but not necessarily all examples, the support member $\mathbf{2}_i$ is a printed circuit board $\mathbf{2}_i$.

In other examples, the first portion 12 of a conductive arm 16 of a dipole antenna $\mathbf{10}_m$; the first portion 22 of a conductive arm 18 of another dipole antenna $\mathbf{10}_n$; and the second portion 14 of the conductive arm 16 of the dipole antenna $\mathbf{10}_m$ can be sheet metal radiators which are spaced apart. The spacing between the radiators could be maintained by having just one or more plastic spacers and the dielectric between them is mostly air. The conductive element 24 could be provided on a horizontally disposed plastic spacer which is only the width of this element but extends lengthwise behind the gap 6 and is coupled mechanically not only to the conductive element 24 but also to the first portion 22 of a conductive arm 18 of another dipole antenna $\mathbf{10}_n$ and the second portion 14 of the conductive arm 16 of the dipole antenna $\mathbf{10}_m$. The plastic spacer could be heat-staked to the sheet metal radiators. In this example, and other examples, the support member $\mathbf{2}_i$ is not necessarily a single component but is a component built and formed into a single component by a variety of sub-parts.

A support member $2_i$ can, alternatively be manufactured using a moulding process, for example molded interconnect devices (MID) or other molded substrate type technologies. The conductive portions in MID are provided by a special second-shot of plateable plastic. In a laser type molded substrate one can use Laser Direct Structuring (LDS). There are other manufacturing technologies using similar techniques to achieve the same goal.

A support member $2_i$ comprises the supporting infrastructure that keeps the conductive arm 16 of a dipole antenna $10_m$, the first portion 22 of a conductive arm 18 of another dipole antenna $10_n$; and, if present, the conductive element 24 in a fixed spatial relationship and comprises the conductive arm 16 of a dipole antenna $10_m$, the first portion 22 of a conductive arm 18 of another dipole antenna $10_n$; and, if present, the conductive element 24.

In some examples one or more of the conductive arm 16 of a dipole antenna $10_m$, the first portion 22 of a conductive arm 18 of another dipole antenna $10_n$; and the conductive element 24 are stiff, for example formed from sheet metal, and provide part of the supporting infrastructure of the support member $2_i$. The supporting infrastructure of the support member $2_i$ can be augmented using stiff, insulating spacers.

In some examples one or more of the conductive arm 16 of a dipole antenna $10_m$, the first portion 22 of a conductive arm 18 of another dipole antenna $10_n$; and the conductive element 24 are not stiff and a supporting substrate is provided as part of the supporting infrastructure of the support member $2_i$.

In some examples the conductive arm 16 of a dipole antenna $10_m$, the first portion 22 of a conductive arm 18 of another dipole antenna $10_n$; and, if present, the conductive element 24 are not stiff and a supporting substrate is provided as part of the supporting infrastructure of the support member $2_i$. In this example, the supporting substrate may be a substrate of a printed circuit board.

The description of 'connection' or 'coupling' means that any number or combination of intervening elements can exist (including no intervening elements).

Where a structural feature has been described, it may be replaced by means for performing one or more of the functions of the structural feature whether that function or those functions are explicitly or implicitly described.

In some but not necessarily all examples, the apparatus 2, 100, 300 is used in a host apparatus configured to communicate data from the host apparatus with or without local storage of the data in a memory at the apparatus and with or without local processing of the data by circuitry or processors at the apparatus.

In some examples the host apparatus is a bas station of a cellular communications network, for example an eNB. The base station may communicate in a cell of any suitable size.

The antennas described may be configured to operate in one or more operational resonant frequency bands. For example, the operational frequency bands may include (but are not limited to) Long Term Evolution (LTE) (US) (734 to 746 MHz and 869 to 894 MHz), Long Term Evolution (LTE) (rest of the world) (791 to 821 MHz and 925 to 960 MHz), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); hiper local area network (HiperLAN) (5150-5850 MHz); global positioning system (GPS) (1570.42-1580.42 MHz); US—Global system for mobile communications (US-GSM) 850 (824-894 MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting—handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification low frequency (RFID LF) (0.125-0.134 MHz); radio frequency identification high frequency (RFID HF) (13.56-13.56 MHz); radio frequency identification ultra high frequency (RFID UHF) (433 MHz, 865-956 MHz, 2450 MHz); frequency allocations for 5G.

A frequency band over which an antenna can efficiently operate is a frequency range where the antenna's return loss is less than an operational threshold.

As used here 'module' refers to a unit or apparatus that excludes certain parts/components that would be added by an end manufacturer or a user. The printed circuit board 2, the antenna array 100, the system 300 may be modules.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one . . . " or by using "consisting".

In this description, reference has been made to various examples. The description of features or functions in relation to an example indicates that those features or functions are present in that example. The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example.

Although embodiments have been described in the preceding paragraphs with reference to various examples, it should be appreciated that modifications to the examples given can be made without departing from the scope of the claims.

Features described in the preceding description may be used in combinations other than the combinations explicitly described above.

Although functions have been described with reference to certain features, those functions may be performable by other features whether described or not.

Although features have been described with reference to certain embodiments, those features may also be present in other embodiments whether described or not.

The term 'a' or 'the' is used in this document with an inclusive not an exclusive meaning. That is any reference to X comprising a/the Y indicates that X may comprise only one Y or may comprise more than one Y unless the context clearly indicates the contrary. If it is intended to use 'a' or 'the' with an exclusive meaning then it will be made clear in the context. In some circumstances the use of 'at least one' or 'one or more' may be used to emphasis an inclusive meaning but the absence of these terms should not be taken to infer and exclusive meaning.

The presence of a feature (or combination of features) in a claim is a reference to that feature or (combination of features) itself and also to features that achieve substantially the same technical effect (equivalent features). The equivalent features include, for example, features that are variants and achieve substantially the same result in substantially the same way. The equivalent features include, for example, features that perform substantially the same function, in substantially the same way to achieve substantially the same result.

In this description, reference has been made to various examples using adjectives or adjectival phrases to describe characteristics of the examples. Such a description of a characteristic in relation to an example indicates that the characteristic is present in some examples exactly as described and is present in other examples substantially as described.

Whilst endeavoring in the foregoing specification to draw attention to those features believed to be of importance it should be understood that the Applicant may seek protection via the claims in respect of any patentable feature or combination of features hereinbefore referred to and/or shown in the drawings whether or not emphasis has been placed thereon.

The invention claimed is:

1. A support member for arrangement with additional support members to form an array of dipole antennas, the support member comprising:

a first portion of a conductive arm of a dipole antenna;

a first portion of a conductive arm of an other dipole antenna; and a second portion of the conductive arm of the dipole antenna extending from the first portion of the conductive arm of the dipole antenna towards the first portion of the conductive arm of the other dipole antenna, defining a gap in a direct current path between the second portion of the conductive arm of the dipole antenna and the first portion of the conductive arm of the other dipole antenna, wherein the second portion of the conductive arm of the dipole antenna is configured to provide, via capacitive coupling across the gap, a second portion of the conductive arm of the other dipole antenna.

2. The support member as claimed in claim 1 further comprising an additional conductive element, separate from the second portion of the conductive arm of the dipole antenna and configured to capacitively couple with at least the second portion of the conductive arm of the dipole antenna to extend an electrical length of the conductive arm of the dipole antenna.

3. The support member as claimed in claim 2, wherein the additional conductive element and the second portion of the conductive arm of the dipole antenna are separated as a consequence of being in different layers of or on different faces of the support member.

4. The support member as claimed in claim 2, wherein the additional conductive element is separated from the second portion of the conductive arm of the dipole antenna and overlaps the second portion of the conductive arm of the dipole antenna and is separated from the first portion of the conductive arm of the other dipole antenna and overlaps the first portion of the conductive arm of the other dipole antenna.

5. The support member as claimed in claim 1 further comprising a first feed element associated with the first portion of the conductive arm of the dipole antenna and a second feed element associated with the first portion of the conductive arm of the other dipole antenna.

6. The support member as claimed in claim 1 wherein the first portion of the conductive arm of the dipole antenna is a straight conductor extending in a first direction adjacent an edge of the support member, the first portion of the conductive arm of the other dipole antenna is a straight conductor, extending in the first direction adjacent a different edge of the support member, and the second portion of the conductive arm of the dipole antenna is a straight conductor extending in a second direction orthogonal to the first direction.

7. The support member as claimed in claim 1 wherein the first portion of the conductive arm of the dipole antenna, the first portion of the conductive arm of the other dipole antenna and the second portion of the conductive arm of the dipole antenna are on a same face of the support member.

8. An array of dipole antennas comprising four support members as claimed in claim 1, physically arranged to form a hollow parallelepiped.

9. The array of dipole antennas as claimed in claim 8, wherein the second portion of the conductive arm of the dipole antenna for a first support member provides directly a first arm of a first dipole antenna and the second portion of the conductive arm of the dipole antenna for a fourth support member provides indirectly a second arm of the first dipole antenna, wherein the second portion of the conductive arm of the dipole antenna for a second support member provides directly a first arm of a second dipole antenna and the second portion of the conductive arm of the dipole antenna of the first support member provides indirectly a second arm of the second dipole antenna, wherein the second portion of the conductive arm of the dipole antenna for a third support member provides directly a first arm of a third dipole antenna and the second portion of the conductive arm of the dipole antenna for the second support member provides indirectly a second arm of the third dipole antenna and wherein the second portion of the conductive arm of the dipole antenna for a fourth support member provides directly a first arm of a fourth dipole antenna and the second portion of the conductive arm of the dipole antenna for the third support member provides indirectly a second arm of the fourth dipole antenna.

10. The array of dipole antennas as claimed in claim 8, comprising a first feed coupled to the first portions of respective conductive arms that extend along respective support members at a first edge of the parallelepiped, a second feed coupled to the first portions of respective conductive arms that extend along respective support members at a second edge of the parallelepiped, a third feed coupled to the first portions of respective conductive arms that extend along respective support members at a third edge of the parallelepiped and a fourth feed coupled to the first portions of respective conductive arms that extend along respective support members at a fourth edge of the parallelepiped.

11. The array of dipole antennas as claimed in claim 10 further comprising a first electrical interconnection between the first feed and the third feed and a second separate electrical interconnection between the second feed and the fourth feed.

12. A system comprising an array of dipole antennas as claimed in claim 8, inserted within a larger regular array of antennas so that a first subarray of the larger array of antennas is within a void defined by the hollow parallelepiped and a second subarray of the larger array of antennas is outside the hollow parallelepiped.

13. The system as claimed in claim 12, wherein the array of dipole antennas operates at lower frequencies and the larger regular array of antennas operates at a higher frequency.

14. The system as claimed in claim 12, wherein the dipole antennas of the array of dipole antennas are arranged at 45 degrees to dipoles of the larger regular array of antennas.

15. The system as claimed in claim 12, wherein the larger regular array of antennas provides an active 5G antenna array.

* * * * *